US006907815B2

(12) United States Patent
Kim

(10) Patent No.: US 6,907,815 B2
(45) Date of Patent: Jun. 21, 2005

(54) CONTROL APPARATUS OF HYDRAULIC VALVE FOR HOLDING LOAD

(75) Inventor: Jin Wook Kim, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 22 days.

(21) Appl. No.: 10/716,035

(22) Filed: Nov. 18, 2003

(65) Prior Publication Data

US 2004/0237771 A1 Dec. 2, 2004

(30) Foreign Application Priority Data

May 28, 2003 (KR) ..... 10-2003-0034115

(51) Int. Cl.[7] ..... F15B 11/08
(52) U.S. Cl. ..... 91/445; 91/442
(58) Field of Search ..... 91/445, 442

(56) References Cited

U.S. PATENT DOCUMENTS 3,943,825 A * 3/1976 Bianchetta et al. ..... 91/445
4,417,502 A * 11/1983 Shore ..... 91/445
6,186,044 B1 2/2001 Hajek, Jr. et al.
6,691,510 B2 * 2/2004 Kariya et al. ..... 91/445

FOREIGN PATENT DOCUMENTS

| | | |
|---|---|---|
| DE | 10047632 | 4/2002 |
| EP | 1211359 | 6/2002 |

* cited by examiner

*Primary Examiner*—Edward K. Look
*Assistant Examiner*—Michael Leslie
(74) *Attorney, Agent, or Firm*—Ladas & Parry LLP

(57) ABSTRACT

The present invention relates to a control apparatus of a hydraulic valve for holding load in which a drain line of a holding valve adapted to preclude momentary drop of load in a hydraulic actuator is substituted with a path in the interior of a directional control valve, so that a pipe line of a drain side functioning as a hydraulic hose and exposed to the outside is not needed in the present invention. The control apparatus of a hydraulic valve for holding load comprises a drain line adapted to allow hydraulic fluid returned during a switching operation of the sub-spool to flow in a pilot line of the side of a drain corresponding to the opposite side of a pilot line adapted to pressurize the spool of the directional control valve.

8 Claims, 5 Drawing Sheets

CONTROL APPARATUS OF HYDRAULIC VALVE FOR HOLDING LOAD

BACKGROUND OF THE INVENTION

1. Field of the Invention

The present invention relates to a control apparatus of a hydraulic valve for holding load capable of precluding momentary drop of load drop in a hydraulic actuator such as a boom cylinder, etc. for thereby effectively preventing drop of load, and in particular to a control apparatus of a hydraulic valve for holding load in which a drain line of a holding valve adapted to preclude momentary drop of load in a hydraulic actuator is substituted with a path formed in the interior of a directional control valve, so that a pipe line of a drain side functioning as a hydraulic hose and exposed to the outside is not needed in the present invention.

2. Description of the Background Art

As shown in FIGS. 1 and 2, a control apparatus of a hydraulic valve for holding load in a conventional art includes a hydraulic pump 19 and a pilot pump 2 connected to an engine (not shown), a hydraulic actuator (not shown) connected to the hydraulic pump 19 like a boom cylinder, etc., a directional control valve 35 disposed in a flow path between the hydraulic pump 19 and the actuator and controlling a start, stop and direction change of the actuator by a spool 14 that is switched when pilot pressure is applied, a remote control valve (RCV) 1 adapted to supply pilot pressure to the directional control valve 35, a poppet 9 disposed in a flow path between the directional control valve 35 and the actuator and adapted to preclude momentary drop of load in the actuator, and a holding valve 20 connected to a side of a downstream of the poppet 9 and adapted to release upheld load of the actuator by a sub-spool 7 that is switched when pilot pressure is applied.

In the drawings, reference characters A and B represent a flow path connected to the actuator, respectively.

In the case that the spool 14 installed in the directional control valve 35 is at a neutral position (as shown in FIG. 1), a high pressure hydraulic fluid from the hydraulic actuator sequentially flows to a back chamber 10 through a port 12 formed in a holding valve block 18 and a through hole 11 formed in the poppet 9. The flow of the hydraulic fluid is blocked by the sub-spool 7, which is installed in the holding valve 20, and maintains a neutral position.

The poppet 9 is downwardly pressurized due to a difference in a cross section area of the poppet 9 as shown in FIG. 2, so that the hydraulic fluid from the actuator is prevented from being drained into a hydraulic tank, whereby load of an actuator is temporarily prevented from being dropped for thus implementing a holding function.

In the case that it is intended to release holding load function of the actuator, the remote control valve 1 is operated in the direction "b", so that pilot pressure Pb discharged from the pilot pump 2 is introduced into the port of a spool cap 5 engaged in a left end of the directional control valve 35 through the pilot line 4, whereby the inner spool 14 is switched in the right direction shown in FIG. 2.

At the same time, the pilot signal pressure Pb flows through a pilot line 6 divided from the pilot line 4 and enables the sub-spool 7 installed in the holding valve 20 to be switched in the left direction shown in FIG. 2.

At this time, hydraulic fluid of high pressure in the back chamber 10 of the holding valve block 18 is drained to the hydraulic tank 3 through the drain line 8.

As the pressure of the hydraulic fluid of the back chamber 10 is dropped to the pressure of the hydraulic tank, a high load pressure from the actuator enables the poppet 9 to be upwardly moved as shown in FIG. 2 and is fed back to the hydraulic tank through a notch 15 of the spool 14, of which the position is switched, and a return line 16. The load holding function of the hydraulic actuator is released, and the actuator slowly moves downward.

In the control apparatus of a hydraulic valve for holding load in the conventional art, the pilot line 6 adapted to supply pilot pressure to the holding valve 20 for switching the sub-spool 7 and the drain line adapted to drain the hydraulic fluid of the back chamber 120 to the hydraulic tank 3 when the sub-spool 7 is switched are exposed to the outside with the shape of hydraulic hoses and are longitudinally connected.

In the conventional art, as the hydraulic hoses are exposed to the outside, the fabrication cost is increased. The length of the hydraulic hoses of the drain line 8 is increased, so that a backpressure is formed in the drain line. Therefore, the response time is decreased during the operation of the remote control valve 1, so that it is difficult to control the equipment.

SUMMARY OF THE INVENTION

Accordingly, it is an object of the present invention to provide a control apparatus of a hydraulic valve for holding load in which a drain line of a holding valve is substituted with a path formed in the interior of a directional control valve, so that a hydraulic hose exposed to the outside is not needed for thereby decreasing a fabrication cost.

It is another object of the present invention to provide a control apparatus for a hydraulic valve for holding load capable of decreasing the length of a hydraulic hose of a drain line of a holding valve and preventing the response time from being delayed due to the back pressure in drain line, thus enhancing the control performance of an equipment.

To achieve the above objects, there is provided a control apparatus of a hydraulic valve for holding load, comprising a hydraulic pump connected to an engine, an actuator connected to the hydraulic pump, a directional control valve disposed between the hydraulic pump and the actuator and switchable by pilot pressure from a remote control valve and adapted to control a start, stop and direction change of the actuator, a poppet disposed between the directional control valve and the actuator and adapted to preclude momentary drop of load in the actuator, a holding valve block connected to a downstream side of the poppet and having a sub-spool switchable by pilot pressure applied thereto and adapted to release upheld load of the actuator, and a drain line adapted to allow hydraulic fluid returned during a switching operation of the sub-spool to flow in a pilot line of the side of a drain corresponding to the opposite side of a pilot line adapted to pressurize the spool of the directional control valve.

To achieve the above objects, there is provided a control apparatus of a hydraulic valve for holding load, comprising a hydraulic pump connected to an engine, an actuator connected to the hydraulic pump, a directional control valve disposed between the hydraulic pump and the actuator and switchable by pilot pressure from a remote control valve and adapted to control a start, stop and direction change of the actuator, a poppet disposed between the directional control valve and the actuator and adapted to preclude momentary drop of load in the actuator, a holding valve block connected to a downstream side of the poppet and having a sub-spool switchable by pilot pressure applied thereto and adapted to release upheld load of the actuator, and a drain line formed in the interiors of the holding valve block and the directional control valve and adapted to allow hydraulic fluid returned during a switching operation of the sub-spool to flow in a pilot line of the side of a drain corresponding to the opposite side of a pilot line adapted to pressurize the spool of the directional control valve.

There is further provided a piston installed in an opposite side of a valve spring of the sub-spool and movable by pilot pressure for thereby switching the sub-spool.

The drain line includes a first drain line communicating with a back chamber formed between the piston and the sub-spool and formed in the interior of the holding valve block, a second drain line having one end connected to the first drain line and formed in the interior of the directional control valve, and a third drain line communicating with the other end of the second drain line and communicating with the pilot line of the side of the drain corresponding to the opposite side of the pilot line adapted to pressurize the spool of the directional control valve.

The drain line includes a first drain line communicating, with the back chamber between the piston and the sub-spool and formed in the interior of the holding valve block, and a fourth drain line having one end communicating with the first drain line, and the other end communicating with the pilot line of the side of the drain corresponding to the opposite side of the pilot line adapted to pressurize the spool of the directional control valve.

There is further provided a first poppet opened during a switching operation of the sub-spool as the piston is moved and formed integrally with the sub-spool for thereby supplying hydraulic fluid of a back chamber to a return line of the actuator, and a second poppet openably and closably installed between the sub-spool and the return line of the actuator and operating in cooperation with the first poppet.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

The preferred embodiments of the present invention will be described with reference to the accompanying drawings.

Figure 1:
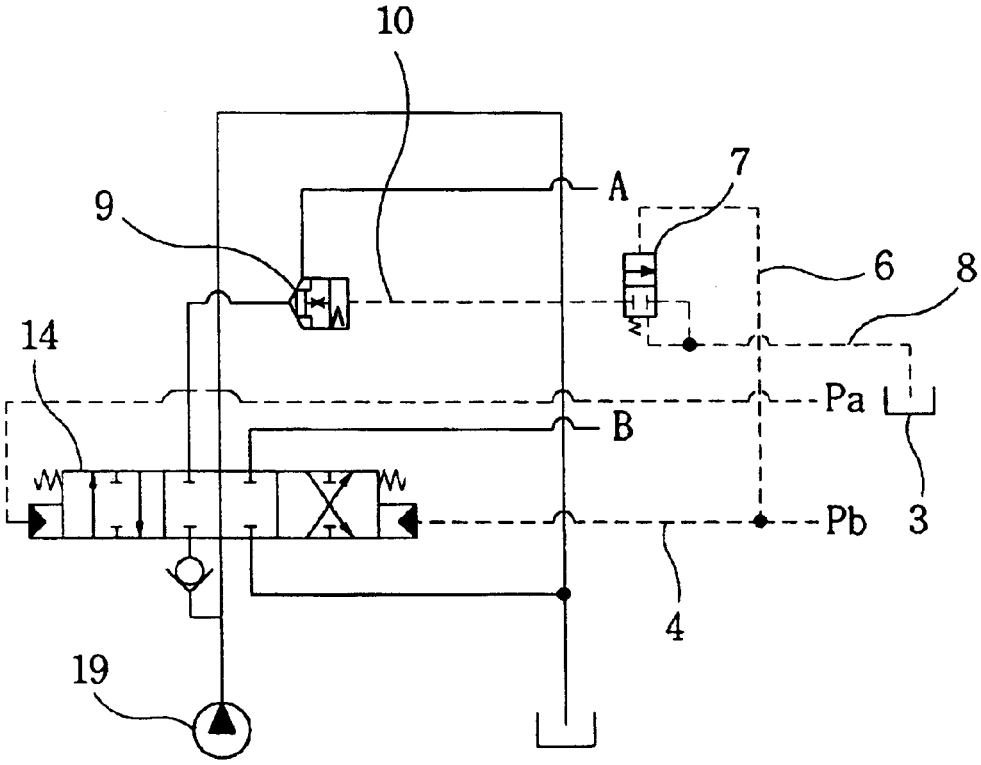
FIG. 1 is a view illustrating a hydraulic circuit of a control apparatus of a hydraulic valve for holding load in a conventional art.
Figure 2:
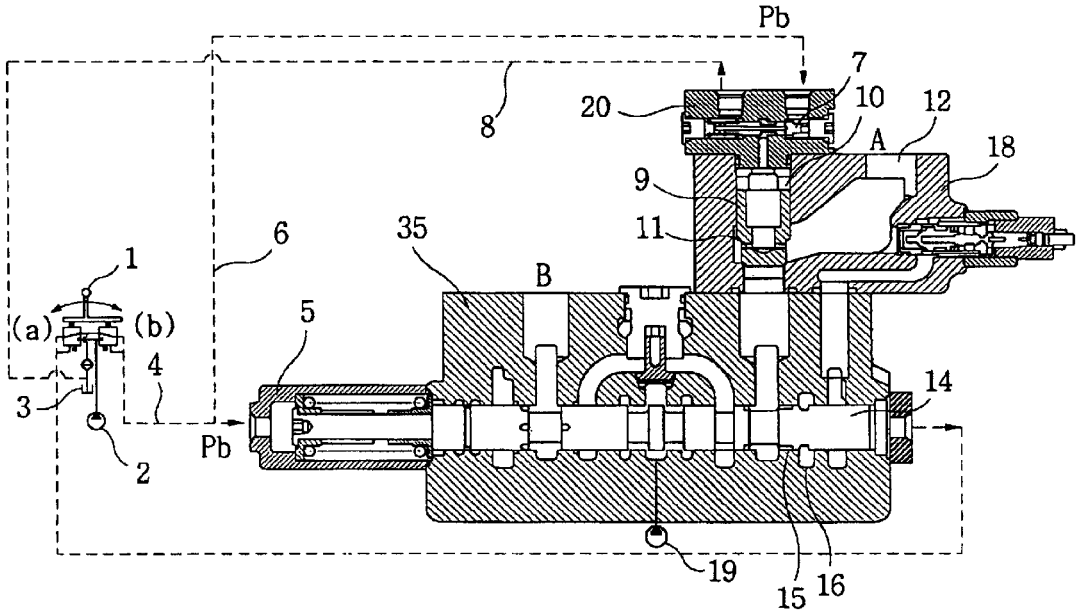
FIG. 2 is a cross sectional view illustrating a control apparatus of a hydraulic valve for holding load in a conventional art.
Figure 3:
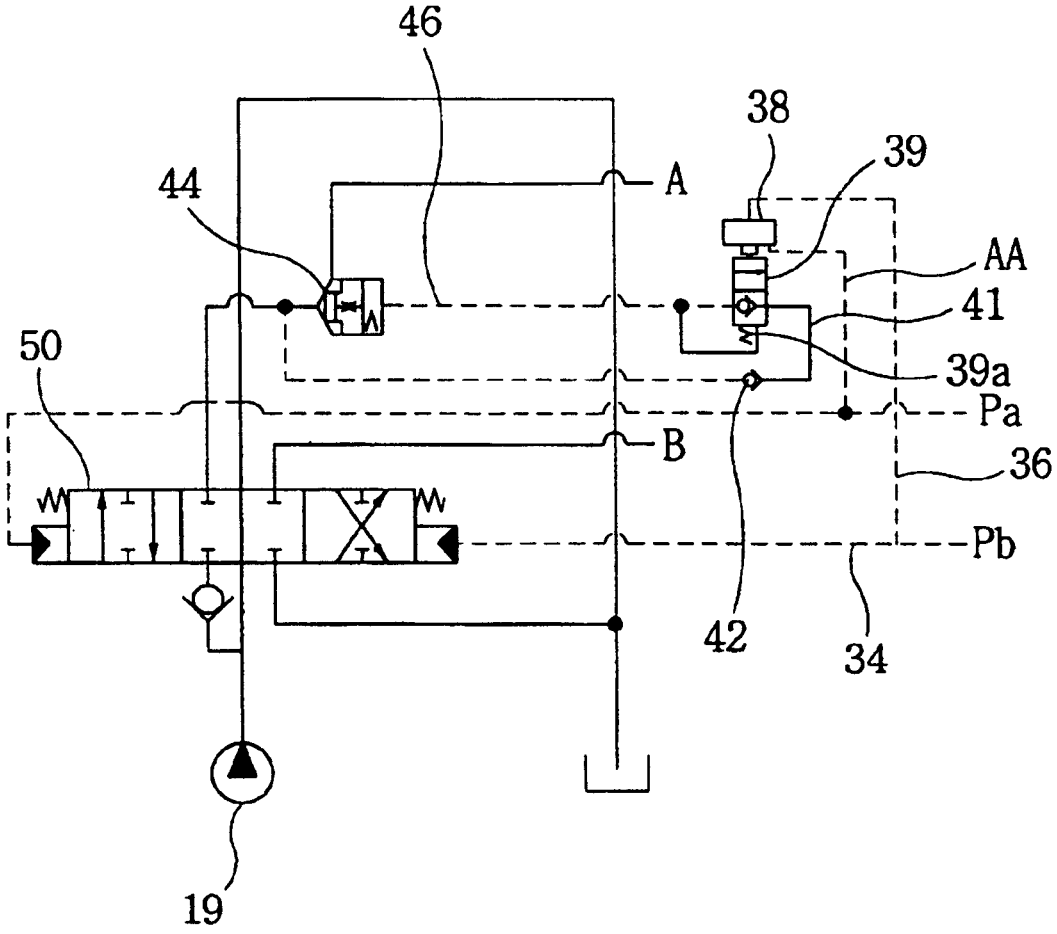
FIG. 3 is a view illustrating a hydraulic circuit of a control apparatus of a hydraulic valve for holding load according to the present invention.
Figure 4:
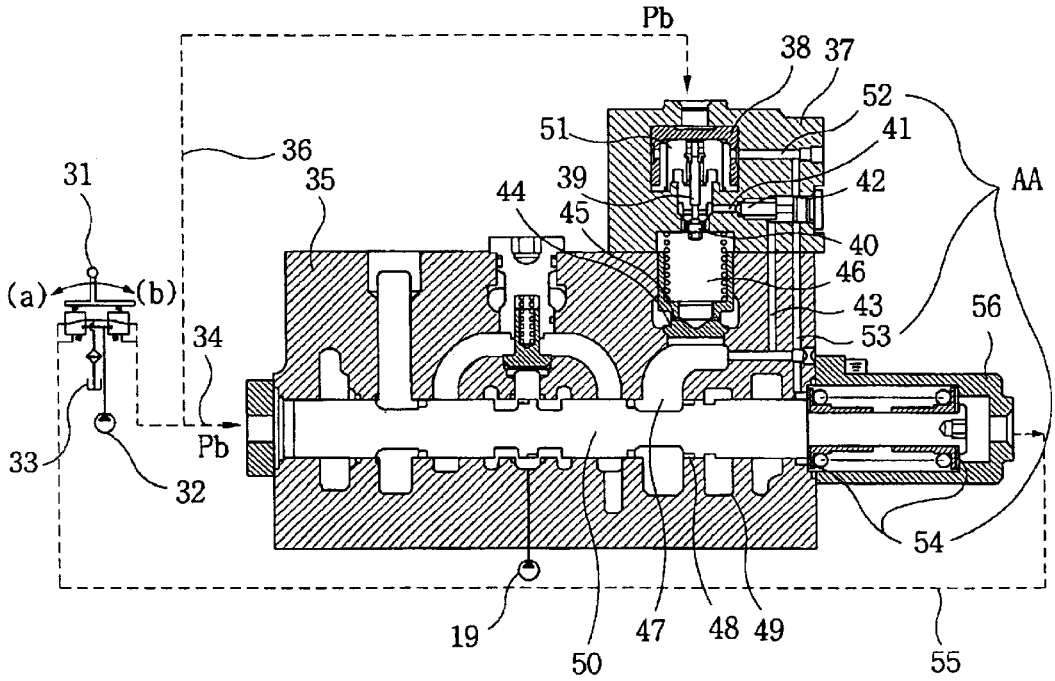
FIG. 4 is a cross sectional view illustrating a control apparatus of a hydraulic valve for holding load according to the present invention.
Figure 5:
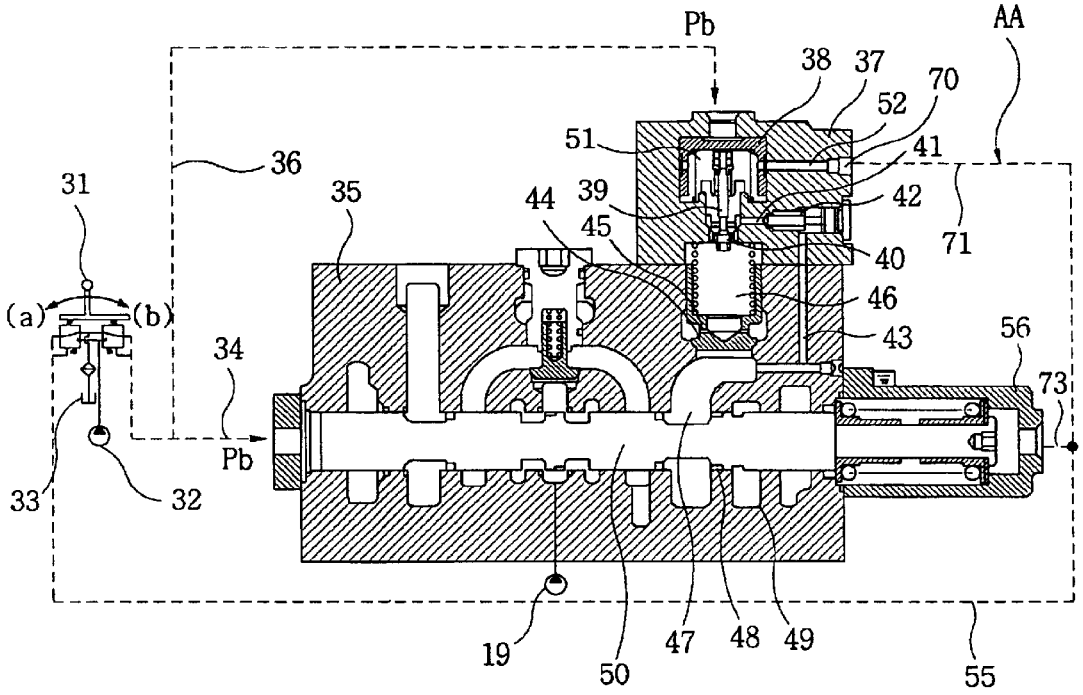
FIG. 5 is a cross sectional view illustrating another embodiment of a control apparatus of a hydraulic valve for holding load according to the present invention.

As shown in FIGS. 3 through 5, the present invention includes a hydraulic pump 19 and a pilot pump 32 connected to an engine (not shown) respectively, an actuator (not shown) connected to the hydraulic pump 19, a directional control valve 35 disposed in a flow path between the hydraulic pump 19 and the actuator and adapted to control start, stop and direction change of the actuator as an internal spool 50 is switched in accordance with pilot pressure applied from a remote control valve (RCV) 31, a poppet 44 disposed in a flow path between the directional control valve 35 and the actuator and adapted to preclude momentary drop of load in the actuator, and a holding valve block 37 connected to a downstream side of the poppet 44 and having a sub-spool 39 switched in accordance with pilot pressure applied from the pilot pump 32 and adapted to release upheld load of the actuator. The above construction is the same as the conventional art. Therefore, the details of the construction and operation will be omitted.

As shown in FIGS. 3 and 4, the control apparatus of a hydraulic valve for holding load according to the present invention includes a piston 38 installed in an opposite side of a valve spring 39*a* of the sub-spool 39 and pressurized in accordance with pilot pressure for thereby switching the sub-spool 39, and a drain line AA adapted to allow hydraulic fluid, which is returned during the switching operation of the sub-spool 39 based on pressurizing operation of the piston 38, to flow into the pilot line 55 of the side of the drain corresponding to the opposite side of the pilot line 34 adapted to pressurize the spool 50 of the directional control valve 35.

There is further provided a first poppet 40 integrally formed in the sub-spool 39 in such a manner that the first poppet 40 is opened during the switching operation of the sub-spool 39 based on the movement of the piston 38 in order to allow hydraulic fluid of the back chamber 46 to be supplied to a return line 47, and a second poppet 42 openably and closably installed in a flow path between the sub-spool 39 and the return line 47 of the actuator and operating in cooperation with the first poppet 40.

As shown in FIG. 4, the drain line AA includes a first drain line 52 provided in the interior of the holding valve block 37 for thereby communicating with the back chamber 51 formed between the piston 38 and the sub-spool 39, a second drain line 53 having one end communicating with the first drain line 52 and being formed in the interior of the directional control valve 35, and a third drain line 54 communicating with the other end of the second drain line 53 and the pilot line 55 of the side of the drain corresponding to the opposite side of the pilot line 34 adapted to pressurize the spool 50 of the directional control valve 35.

The operation of the control apparatus of a hydraulic valve for holding load according to the present invention will be described with reference to the accompanying drawings.

As shown in FIGS. 3 and 4, in order to release load holding function capable of precluding momentary drop of load in hydraulic actuator such as a boom cylinder, etc., the remote control valve 31 is operated in the direction "b", and the pilot signal pressure Pb discharged from the pilot pump 32 is introduced into the left side end of the directional control valve 35 through the pilot line 34, so that the internal spool 50 is switched in the right direction as shown in FIG. 4.

At the same time, the pilot signal pressure Pb is applied through the pilot line 36 divided from the pilot line 34 and pressurizes the piston 38 provided in the holding valve block 37 in the downward direction as shown in FIG. 4. The sub-spool 39 moves downwardly in cooperation with the movement of the piston 38.

At this time, the high pressure oil from the hydraulic actuator (not shown) is flown into the through hole 45 of the poppet 44 provided in the directional control valve 35 and is held by the back chamber 46. The first poppet 40 seated integrally with the sub-spool 39 is downwardly moved as shown in FIG. 4 and is opened, so that the hydraulic fluid held in the back chamber 46 is introduced into the return line 47 through the return line 41, the second poppet 42 and the flow path 43, sequentially.

In the case that the pilot pressure applied to the directional control valve 35 through the pilot line 34 exceeds a certain level, the spool 50 is moved in the right direction as shown in FIG. 4, so that the return line 47 comes to communicate with the hydraulic tank 49 by a notch portion 48 formed in one side of the outer surface of the spool 50, whereby the pressure of the hydraulic fluid of the back chamber 46 is dropped to the pressure level of the hydraulic tank.

Therefore, the poppet 44 is upwardly moved by the pressure difference as shown in FIG. 4. The hydraulic fluid, which is returned from the actuator, is fed into the hydraulic tank 49, and load holding function of the hydraulic actuator is released, so that the actuator is gradually operated in the downward direction.

At this time, the hydraulic fluid of the back chamber 51 formed between the piston 38 and the sub-spool 39 flows through the drain line AA (52, 53, 54) formed in the interior of the holding valve block 37 and the directional control valve 35. When the hydraulic fluid passes through the spool cap 56 provided in the right end of the directional control valve 35, the hydraulic fluid is drained to the hydraulic tank 33 through the pilot line 55 of the side of the drain corresponding to the opposite side of the pilot line 34 adapted to pressure the spool 50 of the directional control valve 35.

The drain line of the holding valve adapted to preclude spontaneous drop of load in the hydraulic actuator is combined with the pilot line 55 of the side of the drain of the directional control valve 35 through the passage type drain lines 52, 53 and 54 formed in the interiors of the holding valve block 37 and the directional control valve 35. Therefore, it is not needed to use externally exposed hydraulic hoses. The fabrication cost and the length of the drain line are decreased. It is possible to prevent the response time from being decreased during the operation of the remote control valve 31.

As shown in FIG. 5, in the control apparatus of a hydraulic valve for holding load according to another embodiment of the present invention, the drain line AA includes a first drain line 52 communicating with the back chamber 51 formed between the piston 38 and the sub-spool 39 and formed in the interior of the holding valve block 37, and a fourth drain line 71 having one end communicating with the first drain line 52 through a drain port 70 and the other end communicating with the drain line 73 that communicates with a spool cap 56 of the directional control valve 35, and the pilot line 55 of the side of the drain corresponding to the opposite side of the pilot line 34 adapted to pressurize the spool 50 of the directional control valve 35.

The constructions except for the above-described constructions are the same as the construction of the earlier one embodiment of the present invention. Therefore, the descriptions of the same constructions will be omitted. The reference numerals for the same constructions will be given the same reference numerals.

Therefore, the first drain line 52 formed in the interior of the holding valve block 37 and the drain line 73 communicating with the spool cap 56 of the directional control valve 35 communicate each other through the fourth drain line 71 provided between the first drain line 52 and the drain line 73, so that the hydraulic fluid returned during the switching operation of the sub-spool 39 is allowed to flow into the pilot line 55 of the side of the drain of the directional control valve 35 for thereby draining the hydraulic fluid into the hydraulic tank 33.

Therefore, in the present invention, the drain line of the holding valve is extended to the outside of the directional control valve 35. Therefore, the length of the hydraulic hose is decreased, so that it is possible to prevent back pressure from being formed in the drain line.

The control apparatus of the hydraulic valve for holding load according to the present invention has the following advantages.

The drain line of the holding valve adapted to preclude momentary drop of load in the hydraulic actuator is connected to the pilot line of the side of the drain corresponding to the opposite side of the pilot line of the pressurizing side of the directional control valve through the internal path of the directional control valve, so that it is not needed to use the hydraulic hose exposed to the outside for thereby decreasing the fabrication cost.

In addition, the length of the hydraulic hose of the drain line of the holding valve is decreased, so that it is possible to prevent the response time from being decreased due to the back pressure formed in the drain line, for thereby enhancing the performance of an expensive heavy equipment.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A control apparatus of a hydraulic valve for holding load, comprising:

a hydraulic pump connected to an engine;

an actuator connected to the hydraulic pump;

a directional control valve disposed between the hydraulic pump and the actuator and switchable by pilot pressure from a remote control valve and adapted to control a start, stop and direction change of the actuator;

a poppet disposed between the directional control valve and the actuator and adapted to preclude momentary drop of load in the actuator;

a holding valve block connected to a downstream side of the poppet and having a sub-spool switchable by pilot signal pressure applied thereto and adapted to release upheld load of the actuator; and a drain line adapted to allow hydraulic fluid returned during a switching operation of the sub-spool to flow in a pilot line of the side of a drain corresponding to the opposite side of a pilot line adapted to pressurize the spool of the directional control valve.

2. The apparatus of claim 1, further comprising a piston installed in an opposite side of a valve spring of the sub-spool and movable by pilot pressure for thereby switching the sub-spool.

3. The apparatus of claim 2, further comprising:

a first poppet opened during a switching operation of the sub-spool as the piston is moved and formed integrally with the sub-spool for thereby supplying hydraulic fluid of a back chamber to a return line of the actuator; and a second poppet openably and closably installed between the sub-spool and the return line of the actuator and operating in cooperation with the first poppet.

4. A control apparatus of a hydraulic valve for holding load, comprising:

a hydraulic pump connected to an engine;

an actuator connected to the hydraulic pump;

a directional control valve disposed between the hydraulic pump and the actuator and switchable by pilot pressure from a remote control valve and adapted to control a start, stop and direction change of the actuator;

a poppet disposed between the directional control valve and the actuator and adapted to preclude momentary drop of load in the actuator;

a holding valve block connected to a downstream side of the poppet and having a sub-spool switchable by pilot pressure applied thereto and adapted to release upheld load of the actuator; and a drain line formed in the interiors of the holding valve block and the directional control valve, and adapted to allow hydraulic fluid returned during a switching operation of the sub-spool to flow in a pilot line of the side of a drain corresponding to the opposite side of a pilot line adapted to pressurize the spool of the directional control valve.

5. The apparatus of claim 4, further comprising a piston installed in an opposite side of a valve spring of the sub-spool and being moved in accordance with pilot pressure for thereby switching the sub-spool.

6. The apparatus of claim 4, wherein said drain line includes:

a first drain line communicating with a back chamber formed between the piston and the sub-spool and formed in the interior of the holding valve block;

a second drain line having one end connected to the first drain line and formed in the interior of the directional control valve; and a third drain line communicating with the other end of the second drain line and communicating with the pilot line of the side of the drain corresponding to the opposite side of the pilot line adapted to pressurize the spool of the directional control valve.

7. The apparatus of claim 1, wherein said drain line includes:

a first drain line communicating with the back chamber between the piston and the sub-spool and formed in the interior of the holding valve block; and a fourth drain line having one end communicating with the first drain line, and the other end communicating with the pilot line of the side of the drain corresponding to the opposite side of the pilot line adapted to pressurize the spool of the directional control valve.

8. The apparatus of claim 5, further comprising:

a first poppet opened during a switching operation of the sub-spool as the piston is moved and formed integrally with the sub-spool for thereby supplying hydraulic fluid of a back chamber to a return line of the actuator; and a second poppet openably and closably installed between the sub-spool and the return line of the actuator and operating in cooperation with the first poppet.

* * * * *